US005186021A

United States Patent [19]

Keller

[11] Patent Number: 5,186,021

[45] Date of Patent: Feb. 16, 1993

[54] BYPASS EXPANSION DEVICE HAVING DEFROST OPTIMIZATION MODE

[75] Inventor: Fred J. Keller, Indianapolis, Ind.

[73] Assignee: Carrier Corporation, Syracuse, N.Y.

[21] Appl. No.: 702,471

[22] Filed: May 20, 1991

[51] Int. Cl.[5] ..... F25B 41/06; F25B 41/04; F16K 31/02

[52] U.S. Cl. ..... 62/511; 62/324.6; 62/527; 62/528; 137/513.3; 137/625.33

[58] Field of Search ..... 62/511, 527, 528, 324.6; 137/625.33, 513.3

[56] References Cited

U.S. PATENT DOCUMENTS

| | | | |
|---|---|---|---|
| 3,814,134 | 6/1974 | Vanti | 137/513.3 X |
| 3,992,898 | 11/1976 | Duell et al. | 62/324.6 |
| 4,152,030 | 5/1979 | Blomberg et al. | 137/513.3 X |
| 4,240,468 | 12/1980 | Brand et al. | 137/625.33 |
| 4,402,344 | 9/1983 | Kemmner | 137/625.33 |
| 4,459,819 | 7/1984 | Hargraves | 62/511 X |
| 4,632,358 | 12/1986 | Orth et al. | 62/528 X |
| 4,653,291 | 3/1987 | Moeller et al. | 62/527 X |
| 4,704,947 | 11/1987 | Schneider | 137/513.3 X |
| 4,784,177 | 11/1988 | Sepso et al. | 137/513.3 |

FOREIGN PATENT DOCUMENTS

| | | | |
|---|---|---|---|
| 0321670 | 6/1989 | European Pat. Off. | 62/527 |

*Primary Examiner*—Henry A. Bennet
*Assistant Examiner*—Christopher B. Kilner

[57] ABSTRACT

A refrigerant expansion device including a body having a flow passage extending therethrough which may pass refrigerant in either direction. A piston is slideably mounted in the flow passage for movement between a first position and a second position in response to the direction of refrigerant flow through the flow passage. The piston has a metering port extending therethrough for metering the flow of refrigerant when the piston is moved to the first position responsive to the flow of refrigerant in one direction through the metering device. The piston also includes at least one flow channel substantially parallel to the metering port for passing a substantially unrestricted flow of refrigerant when the piston is moved away from the first position in the direction of the second position responsive to the flow of refrigerant in the opposite direction. Means are provided for moving the piston, against the flow of refrigerant in the one direction away from the first position. As a result the expansion device will allow substantially unrestricted flow therethrough in the direction in which it normally meters refrigerant.

5 Claims, 2 Drawing Sheets

BYPASS EXPANSION DEVICE HAVING DEFROST OPTIMIZATION MODE

BACKGROUND OF THE INVENTION

1. Field of the Invention

This invention relates in general to refrigerant expansion devices for use in heat pump systems. More specifically, this invention relates to expansion devices of the type including a moveable piston having a metering port therein which is moveable, responsive to the flow of refrigerant from a refrigerant metering position to a refrigerant by-pass position.

2. Description of the Prior Art

Conventional heat pumps include a refrigeration circuit with a compressor and indoor and outdoor heat exchanger coils which function alternately as a condenser and an evaporator in response to a thermostat controlled valve which reverses the direction of refrigerant flow through the circuit between heating and cooling cycles. During cooling cycles the indoor coil functions as an evaporator, absorbing heat from indoor air, and the outdoor coil functions as a condenser, rejecting heat into the outdoor air. During heating cycles the outdoor coil functions as an evaporator absorbing heat from the outdoor air, and the indoor coil functions as a condenser rejecting that heat to the indoor air for comfort heating.

Since the operating conditions of a heat pump depend upon whether it is in a heating cycle or a cooling cycle, it is known to utilize an expansion device dedicated to each of the operating cycles. The conventional method of accomplishing this was to incorporate a double expansion valve and by-pass system in the supply line connecting the two heat exchangers to accomplish throttling in either direction. In the double expansion valve arrangement, two opposed expansion valves are positioned within the refrigerant supply line between the two heat exchangers. A valve operated by-pass is also positioned in parallel with each expansion valve. When the cycle is reversed, the bypass valves are regulated by a control system to alternately utilize one expansion device and by-pass the other. The double by-pass system thus required relatively expensive hardware to implement and a control system to operate the by-pass valves.

U.S. Pat. No. 3,992,898 issued to the assignee hereof, discloses an expansion device which is capable of metering refrigerant flowing therethrough in one direction and freely by-passing refrigerant flowing therethrough in the opposite direction thereby eliminating the need for the expensive by-pass system. In the device of this patent, the refrigerant metering port is formed in a free floating piston which is mounted within a chamber. When refrigerant flows through this device in one direction, the free floating piston moves to one position wherein the refrigerant flow is through the metering port thereby serving as an expansion device. When refrigerant flows through this device in the opposite direction, the free floating piston moves to a second position wherein the refrigerant is allowed to flow through a number of flow channels formed in the outer periphery of the piston to thereby allow substantially unrestricted flow through the device. This arrangement allows such a device to be used, in combination with a second expansion device of the same design, in a heat pump system to allow the desired expansion of the refrigerant through the system flowing in both cooling and heating directions.

As pointed out above, during heating cycles the outdoor coil functions as an evaporator absorbing heat from the outdoor air, and the indoor coil functions as a condenser rejecting that heat to the indoor air for comfort heating. During the time that outdoor temperatures are around 45° and colder, moisture from the outdoor air is collected on the outdoor coil fins in the form of frost. The frost accumulates progressively in thickness on the fins surfaces thereby reducing heat transfer by blocking air flow therethrough, and by the insulating effect on the fin surfaces.

The frost accumulation is periodically removed by temporarily operating the heat pump in a cooling cycle wherein hot gas discharged from the compressor is circulated to the outdoor coil to heat it for frost removal. A defrost cycle is functionally a temporary cooling cycle. It is common practice to initiate defrost cycles by automatic means responsive to the thickness of frost accumulation, or by an interval timer. Termination of defrost cycles are typically caused by a thermostat which senses temperature rise of the outdoor coil, or its condensate, indicating completion of frost removal.

In a typical prior art heat pump system, each heat pump coil may be provided with its own expansion device of the type disclosed in previously discussed U.S. Pat. No. 3,992,898, to meter refrigerant to the coil which is serving as an evaporator. The device serving the outdoor coil, in heating cycles, provides for metering liquid refrigerant to efficiently meet the circumstances of operation during a range of cold outdoor winter temperatures. For example, at a winter ambient of 25° F. the evaporating pressure in the outdoor coil would be approximately 35 psig, and the condensing pressure in the indoor coil 195 psig, establishing a pressure difference across the expansion device of 160 psi.

The expansion device serving the indoor coil during the summer cooling cycles is selected to meter liquid refrigerant to the indoor coil during a range of summer cooling temperatures. As an example, at 85° F. ambient, the condenser pressure in the outdoor coil would be approximately 250 psig, while the evaporating pressure in the indoor coil would be in the range of 72 psig, establishing a pressure difference across the expansion device of 178 psi.

When a defrost cycle is initiated, refrigerant flow is reversed and circulation of refrigerant in the cooling direction is caused to occur for a set time period, or until a set temperature at the outdoor coil, for example, 80°-85° F., is reached. During defrost operation energy penalties are paid which reduce the operating efficiency of the heat pump system. Specifically, during defrost, electrical energy is being consumed by the refrigeration system to defrost the coil with no resultant mechanical heat from the heat pump system being transferred to the heated area. During defrost, heat is actually being removed from the heated area and transferred to the outdoor coil to melt the frost. Further, during the time of defrost, generally, an electrical resistance back up heating system installed in the duct work is actuated to maintain the heated space at a desired comfort level. As a result, it is evident that, it is extremely desirable to minimize the defrost time of a heat pump system in order to increase the operating efficiency of the system. One common measure of the efficiency of a heat pump system is Heating Seasonal Performance Factor, commonly referred to as HSPF. This term is defined by the United States Department of Energy as "the total heating output of a heat pump during its normal annual usage for heating, divided by the total electrical power input during the same period."

Accordingly, since the electrical input is far more efficient when providing heat through the heat pump system, it is extremely desirable to minimize the length of the defrost cycle.

Typical heat pumps are designed with greater outdoor volume than indoor coil volume. This is done to maximize cooling performance which is typically the major selling feature or purpose of the heat pump. As a result, the circulated refrigerant charge quantity is greater during the cooling cycle than the heating cycle.

Upon initiation of defrost, a heat pump is shifted from a heating cycle to a cooling cycle. One factor effecting the length of the defrost cycle is the time required to get into circulation, the proper amount of refrigerant charge to maximize heat transfer from the conditioned space to the cold frosted outdoor coil. When a defrost cycle is initiated, by establishing a temporary cooling cycle under typical winter ambient conditions, the condensing pressure in the outdoor coil is the maximum pressure available for delivering refrigerant from the outdoor coil to the indoor coil through the cooling expansion device. Under such circumstances, the cooling expansion device exhibits a high resistance to flow thereacross because it is designed to control refrigerant flow under a pressure differential in the range of 178 psi as shown in the example given above. Under such circumstances, the compressor is usually required to reduce the pressure in the indoor coil to a very low pressure to establish a pressure differential capable of feeding the indoor coil. In some systems, under certain circumstances, a satisfactory defrost cycle cannot be accomplished with the cooling expansion device serving as the defrost expansion valve.

It has been recognized that during defrost operation, the difference between the high and low pressure sides in a heat pump system is so small that optimal refrigerant circulation is not guaranteed. One approach to solving this problem has been to provide a solenoid actuated by-pass arrangement which provides a large, very low resistance, path by-passing the cooling expansion valve during defrost operations. Such a by-pass allows refrigerant, previously stored in the accumulator during the heating cycle, to be quickly withdrawn and put into circulation where it may deliver heat to the outdoor coil thereby reducing defrost times.

Such a solution to the defrost performance problem however is expensive and represents a step backward in that one of the significant advantages of the combination expansion device was the elimination of the plumbing, valves and controls associated with the by-pass systems.

SUMMARY OF THE INVENTION

It is an object of the present invention to improve defrost performance in a heat pump system which uses a combination metering/by-pass type expansion device.

It is a further object of the present invention to modify a combination metering/by-pass type expansion device to allow by-pass flow therethrough when refrigerant is flowing therethrough in a direction which normally will meter refrigerant.

These and other objects of the present invention area attained by a refrigerant expansion device including a body having a flow passage extending therethrough which may pass refrigerant in either direction. A piston is slideably mounted in the flow passage for movement between a first position and a second position in response to the direction of refrigerant flow through the flow passage. The piston has a metering port extending therethrough for metering the flow of refrigerant when the piston is moved to the first position responsive to the flow of refrigerant in one direction through the metering device. The piston also includes at least one flow channel substantially parallel to the metering port for passing a substantially unrestricted flow of refrigerant when the piston is moved away from the first position in the direction of the second position responsive to the flow of refrigerant in the opposite direction. Means are provided for moving the piston, against the flow of refrigerant in the one direction away from the first position. As a result the expansion device will allow substantially unrestricted flow therethrough in the direction in which it normally meters refrigerant.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts, and wherein

DESCRIPTION OF THE PREFERRED EMBODIMENT

Figure 1:
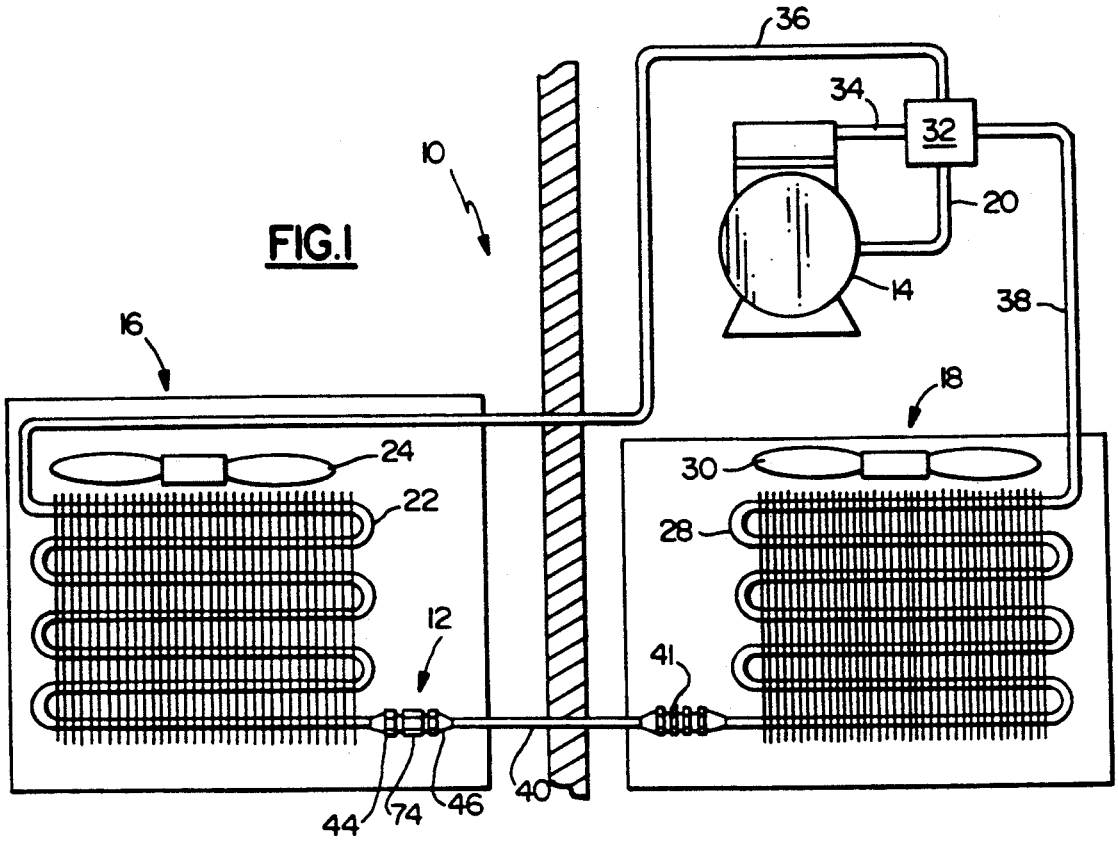
FIG. 1 is a schematic diagram of a heat pump system making use of an expansion device according to the present invention.

With reference first to FIG. 1, numeral 10 designates a heat pump of substantially conventional design, but having a cooling/defrost expansion valve 12 according to the present invention. The cooling/defrost expansion valve 12 operates to meter refrigerant in a conventional manner during the cooling mode of operation and is designed to move to a defrost position during the defrost mode of operation of the sYstem as will be understood as the description continues.

The heat pump system 10 includes a compressor 14, an indoor heat exchanger assembly 16 and an outdoor heat exchanger assembly 18. The indoor heat exchanger assembly 16 includes a refrigerant-to-air heat exchange coil 22 and an indoor fan 24. The outdoor heat exchanger assembly 18 includes a refrigerant-to-air heat exchange coil 28 and an outdoor fan 30. The indoor and outdoor heat exchanger assemblies 16 and 18 are of conventional design and will not be described further herein.

A four way reversing valve 32 is connected to the compressor discharge port by a refrigerant line 34, to the compressor suction port by a refrigerant suction line 20, and, to coils 22 and 28 by refrigerant lines 36 and 38, respectively. The reversing valve 32 is also of a conventional design for directing high pressure vapor from the compressor to either the indoor coil 22 in the heating mode of operation or, during the cooling mode and defrost mode to the outdoor coil 28. Regardless of the mode of operation, the reversing valve 32 serves to return refrigerant from the coil which is operating as an evaporator to the compressor by way of suction line 20.

A refrigerant line 40 interconnects the indoor heat exchanger coil 22 and the outdoor heat exchanger coil 28. The aforementioned cooling/defrost expansion valve 12 is located in the refrigerant line 40 within the indoor heat exchanger assembly 16, adjacent to the indoor coil 22. A second expansion valve 41, designed to optimize operation of the system during the heating mode of operation, is located at the other end of the refrigerant line 40 within the outdoor heat exchange assembly 18, adjacent to the outdoor coil 28. Heating expansion valve 41 is preferably of the by-pass type (according to U.S. Pat. No. 3,992,898 described above) which is configured to meter refrigerant flowing to the outdoor coil 28 when the system is in the heating mode of operation and to allow a free substantially unrestricted by-pass flow of refrigerant therethrough when refrigerant is flowing in the other direction during the cooling and defrost modes of operation.

Turning now to FIGS. 2–5 it will be seen that the cooling/defrost expansion valve 12 comprises a generally cylindrical housing 42 having a male thread formed at each end thereof which is adapted to mate with female connectors 44, 46 (FIG. 1) associated with the refrigerant line 40 to create a fluid tight joint therebetween. A flow passage 48, which is axially aligned with the housing body 42, passes into the body from the left hand side of the expansion device as viewed in FIG. 2.

The diameter of the flow passage is substantially equal to the internal opening contained within the supply line 40 and is thus capable of supporting the flow passing therethrough. The flow passage 48 opens into an expanded chamber 50, bored or otherwise machined into the opposite end of the housing body. The open end of the chamber is provided with a nipple 52 which is pressed-fitted therein and contains a tapered internal opening 54, which narrows down to the diameter of the internal opening of the supply line. An 'O' ring 56 is carried within an annular groove formed about the outer periphery of the nipple which serves to establish a fluid tight seal between the internal wall of the expanded chamber 50 and the nipple.

Figure 2:
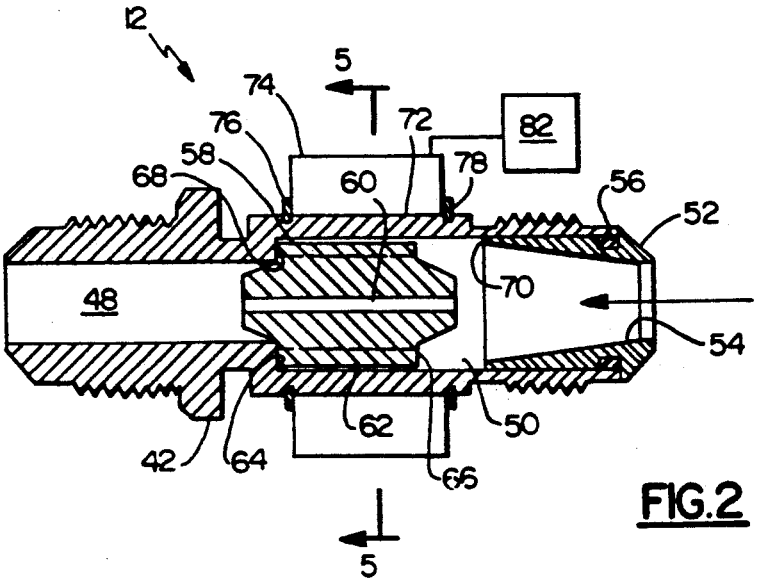
FIG. 2 is a longitudinal sectional view through an expansion device according to the present invention shown in the cooling mode of operation.

A free floating piston 58 is slideably mounted within the expanded chamber. The piston has a centrally located metering port extending longitudinally therethrough, and, a plurality of fluid flow channels 62, which are axially aligned with the metering port which are formed in the outer periphery of the piston. The piston is of a predetermined length and, upon assembly, is permitted to slide freely in an axial direction within the chamber. The piston is provided with two flat parallel annular shaped end faces 64 and 66. The left hand end face 64, as illustrated in FIG. 2, is adapted to engage and be stopped by the right hand facing end wall 68 of the expanded chamber 50. The right hand end face 66 is adapted to engage and be stopped by a flat 70 provided on the inside end of the nipple 52.

The depth of each of the fluid flow channels 62 formed within the piston is less than the radial depth of the expanded chamber end wall 68, as a result, the fluid flow channels are closed when the piston is operably engaged with the chamber end wall as shown in FIG. 2. On the other hand, when the piston is in operative contact with the nipple the fluid flow channels open directly into the tapered opening 54 passing through the nipple. The combined area of the fluid flow channels 62 is substantially equal to or slightly greater than the internal opening of the supply line whereby the channels are capable of passing a flow at least equal to that accommodated by the supply line.

Figure 3:
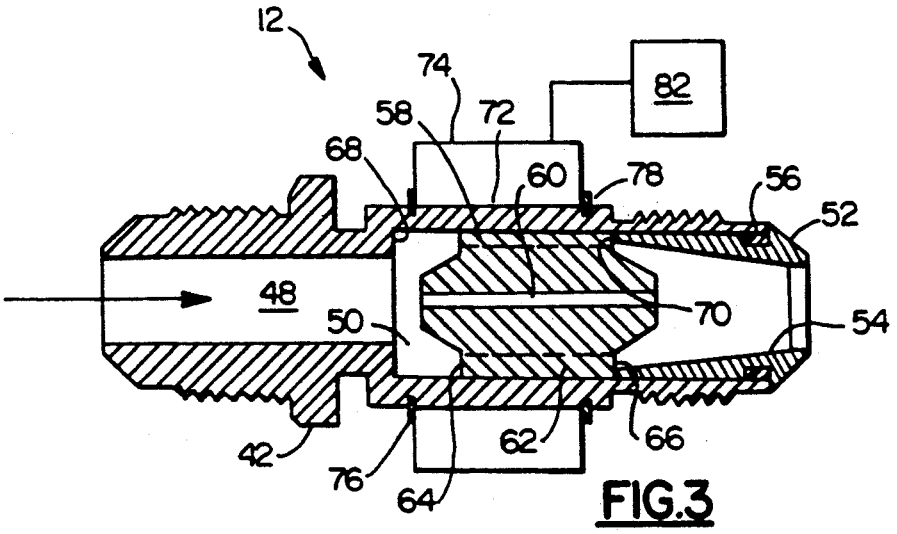
FIG. 3 is a longitudinal sectional view through an expansion device according to the present invention in the heating mode of operation.
Figure 4:
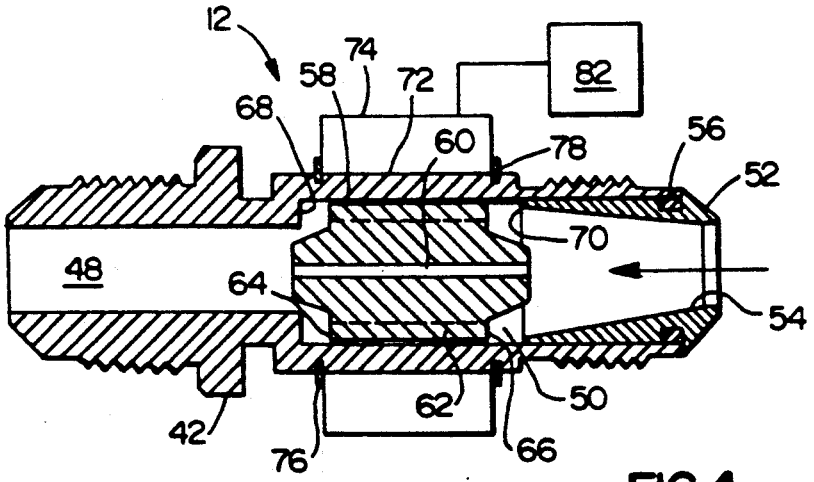
FIG. 4 is a longitudinal sectional view through an expansion device according to the present invention during the defrost mode of operation.
Figure 5:
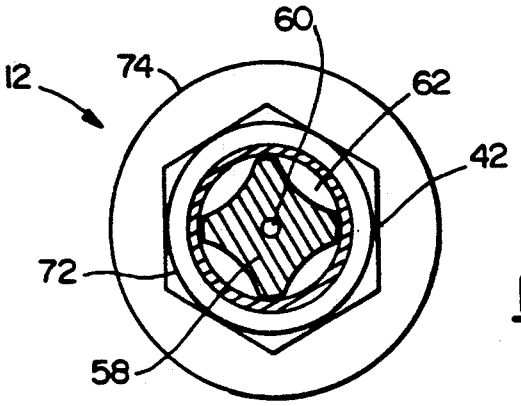
FIG. 5 is a sectional view of the expansion device taken along the lines 5—5 of FIG. 2.

The piston 58 is made from a magnetic material which will not be adversely effected by the refrigerant environment in which the device operates, such as, for example, a stainless steel. The body housing 42 is made from a non-magnetic material, such as for example brass and includes a substantially uniform diameter exterior wall portion 72 surrounding the expanded chamber 50. A conventional solenoid coil 74 encircles the outside portion 72 of the body as seen in FIGS. 2,3 and 4. The coil is held in the desired position by a stop 76 formed in the housing body adjacent the left hand end of the coil and a removable retainer clip or the like 78 which may snap fit into a groove 80 formed in the outside of the housing following installation of the coil.

The solenoid coil is preferably a 24 volt AC actuated coil and is connected to appropriate control circuitry 82 designed to actuate the coil as desired upon initiation of a defrost cycle as will be described below.

In operation, the expansion device 12, as shown in FIG. 2 is arranged to throttle refrigerant in the cooling mode as it moves, as indicated by the directional arrow, from heat exchanger 18 to heat exchanger 16. Under the influence of the flowing refrigerant, the piston has moved to the illustrated position thus closing the fluid flow channels 62 against the end wall of the expanded chamber whereby the refrigerant is forced to pass through the more restricted metering port to throttle the refrigerant from the high pressure side of the system to the low pressure side.

Similarly, when the cycle is reversed and refrigerant is caused to flow in the opposite direction, the piston is automatically moved to a second position against the nipple. The fluid flow channels, which are now opened to the tapered hole formed in the nipple, present the path of least resistance to the refrigerant and thus provide an unrestricted flow path around the metering port through which the refrigerant can freely enter the downstream supply line. The expansion valve 12 is shown in the by-pass condition, with the refrigerant flow as shown by the flow arrow, in FIG. 3.

As indicated above, in the background of the invention, at certain times during the operation of the system in the heating mode, it is necessary to reverse the flow of refrigerant in order to defrost the outdoor coil 28. During defrost the refrigerant flow through the valve is from right to left as illustrated in FIG. 4. With continued reference to FIG. 4, upon initiation of the defrost mode of operation, the control circuit 82 energizes the solenoid coil 74. At this time, as a result of the magnetic field generated by the energized coil the piston 58 is caused to move, against the flow of the refrigerant through the valve, to a position out of engagement with the end wall 68 of the expansion chamber 50 to thereby disengage the fluid flow channels 62 from the end wall. With the piston in this position, refrigerant flow is allowed both through the metering port 60 as well as the plurality of by-pass flow channels 62 thereby providing a substantially unrestricted flow of refrigerant through the valve. Such positioning of the piston allows a free flow of hot refrigerant to pass to the outdoor coil to maximize heat transfer to the coil and thus substantially reduce the time necessary to defrost the coil.

It should be appreciated that it is not necessary for the solenoid 74 to move the piston 58 to the extreme right as illustrated in FIG. 3 to achieve the substantially increased flow which is desired to increase defrost. The position intermediate the metering position and the by-pass position which is illustrated in FIG. 4 is deemed entirely satisfactory to increase the flow during the defrost mode to achieve the accelerated delivery of refrigerant through the valve.

Accordingly, it should be appreciated that an improvement upon the operation of a refrigerant expansion device of the type having a refrigerant metering position and a by-pass position has been provided which allows the device to be operated in a modified cooling mode whereby free by-pass of refrigerant through the valve is allowed when refrigerant is flowing through the valve in the cooling direction.

This invention maybe practiced or embodied in still other ways without departing from the spirit or essential characteristics thereof. The preferred embodiment described herein is therefore illustrative and not restrictive, the scope of the invention being indicated by the appended claims and all variations which come within the meaning of the claims are intended to be embraced therein.

What is claimed is:

1. An expansion device for passing a flow of refrigerant therethrough comprising:

a body having a flow passage therethrough for passing a flow of refrigerant in either direction;

a piston, slideably mounted in said flow passage for normally free unopposed movement between a first position and a second position in response to the force imparted thereupon by the flow of refrigerant through said flow passage in a first direction, and, a second direction respectively;

said piston having a metering port extending therethrough for metering the flow of refrigerant therethrough when said piston is moved to said first position responsive to the flow of refrigerant in said first direction, and, at least one flow channel substantially parallel to said metering port for passing a substantially unrestricted flow of refrigerant when said piston is moved away froms aid first position in the direction of said second position, responsive to the flow of refrigerant in said second direction; and selectively actuatable means, not in physical contact with said piston, for imparting a force upon said pistion, when actuated, which acts in said second direction, which is sufficient to move said pistion, against the force imparted thereupon by the flow of refrigerant in said first direction, away from said first position.

2. The apparatus of claim 1 whereins aid means for imparting a force moves said piston to a third position which is intermediate said first and second positions.

3. The apparatus of claim 1 wherein said means for moves said pistion to said second position.

4. The apparatus of claim 1 wherein said piston is made from a magnetic material, and, said means for imparting a force comprises a solenoid coil.

5. The apparatus of claim 4 wherein said body is made from a non-magnetic material and said piston is made from stainless steel.

* * * * *